United States Patent [19]

Ayer

[11] 3,936,119

[45] Feb. 3, 1976

[54] TERMINAL BLOCK HAVING FLAT FLEXIBLE INTERCONNECTING CIRCUITS

[75] Inventor: George Edward Ayer, Endicott, N.Y.

[73] Assignee: Bunker Ramo Corporation, Oak Brook, Ill.

[22] Filed: Jan. 16, 1974

[21] Appl. No.: 433,630

[52] U.S. Cl. ..... 339/17 F; 339/97 R; 339/176 MF

[51] Int. Cl.[2] ..... H01R 13/46

[58] Field of Search..... 339/17 R, 17 E, 17 F, 97 R, 339/97 P, 98, 99 R, 176 MF, 176 MP, 193 P

[56] References Cited

UNITED STATES PATENTS

| | | | |
|---|---|---|---|
| 3,086,189 | 4/1963 | Robbins | 339/176 MP |
| 3,112,147 | 11/1963 | Pferd | 339/97 P |
| 3,496,522 | 2/1970 | Ellis | 339/99 R |
| 3,546,775 | 12/1970 | Lalmond | 339/17 F |
| 3,701,964 | 10/1972 | Cronin | 339/176 MF |
| 3,705,377 | 12/1972 | Hansen | 339/176 |
| 3,727,168 | 4/1973 | Henschen | 339/17 F |
| 3,796,986 | 3/1974 | Tamburro | 339/176 MF |

*Primary Examiner*—Joseph H. McGlynn
*Assistant Examiner*—Mark S. Bicks
*Attorney, Agent, or Firm*—Fred Fisher; F. M. Arbuckle

[57] ABSTRACT

A terminal block assembly includes a plurality of insulationpiercing type terminals which are interconnected with the contacts of one or more electrical connectors by flat flexible circuits. The terminal block includes upstanding sidewalls having recesses therein, which together with a removable cover, form exit openings for the flat flexible circuits and maintain the flat flexible circuits out of an interference relationship with the cover. An electrical connector is mounted on the terminal block adjacent each opening and includes contacts connected to the individual circuits.

6 Claims, 8 Drawing Figures

76
96
74''
100
102
72
98
86
90
88
84
94
92
80
82
78
62
58
68
70
66
14
64
91

TERMINAL BLOCK HAVING FLAT FLEXIBLE INTERCONNECTING CIRCUITS

BACKGROUND OF THE INVENTION

1. Field of the Invention

This invention relates to terminal blocks, and more particularly to terminal blocks in which the terminals are interconnected with one or more electrical connectors by flexible flat circuits.

2. Description of the Prior Art

The utilization of an electrical connector in conjunction with a terminal block is known in the art. For example, in my co-pending United States patent application entitled "Connector Retaining Adapter," Ser. No. 407,127, filed Oct. 17, 1973, now U.S. Pat. No. 3,887,259, issued June 3, 1975, assigned to Bunker Ramo Corporation, I disclose an adapter for mechanically connecting an electrical connector to a terminal block. The terminals of the terminal block and the contacts of the electrical connector are interconnected by individual wires. Although this structure has proven highly advantageous for interconnecting selected ones or all of the contacts of one or more terminal blocks to a multi-conductor cable, the interconnections are done by hand giving rise to excessive wiring time and errors in interconnection.

SUMMARY OF THE INVENTION

The object of the present invention is to provide a terminal block assembly including at least one electrical connector mounted thereon in which the interconnections between the terminals of the terminal block and the contacts of the electrical connector are effected in a simple, quick and economic manner.

Another object of the invention is to provide selective interconnections between the terminals of a terminal block and the contacts of one or more electrical connectors mounted thereon in a simple, yet faultless manner.

According to the invention, a terminal block is provided with a pair of upstanding sidewalls and a plurality of intermediate upstanding lower walls which position the terminals below the extent of the sidewalls. One or more flat flexible circuits, each of which may be a laminated structure, carries individual circuits which selectively interconnect the terminals with the contacts of one or more electrical connectors mounted on the sides of the sidewalls. A recess in a sidewall adjacent an electrical connector provides an access opening for the flat flexible member and maintains the flexible member below the extremities of the upstanding sidewalls to prevent interference between the flexible member and a removable cover which slidably engages the terminal block proper.

The flexible flat circuit members are generally T-shaped with the cross bar portions of the T generally co-extensive and the leg portions of the T of different lengths so that, for example, when two or more flexible flat circuits are employed, the leg of the T of one or more of the circuits is folded back over the circuits of another circuit member to exit from the terminal block at a side of the block opposite the exit side for the other circuit member. Thus an electrical connector can be mounted on opposite sides of the block for connection to the contacts in the block.

BRIEF DESCRIPTION OF THE DRAWINGS

Other objects, features and advantages of the invention, its organization, construction and operation will be best understood from the following detailed description of a preferred embodiment of the invention, taken in conjunction with the accompanying drawings, on which.

DESCRIPTION OF A PREFERRED EMBODIMENT

Figures 1, 8:
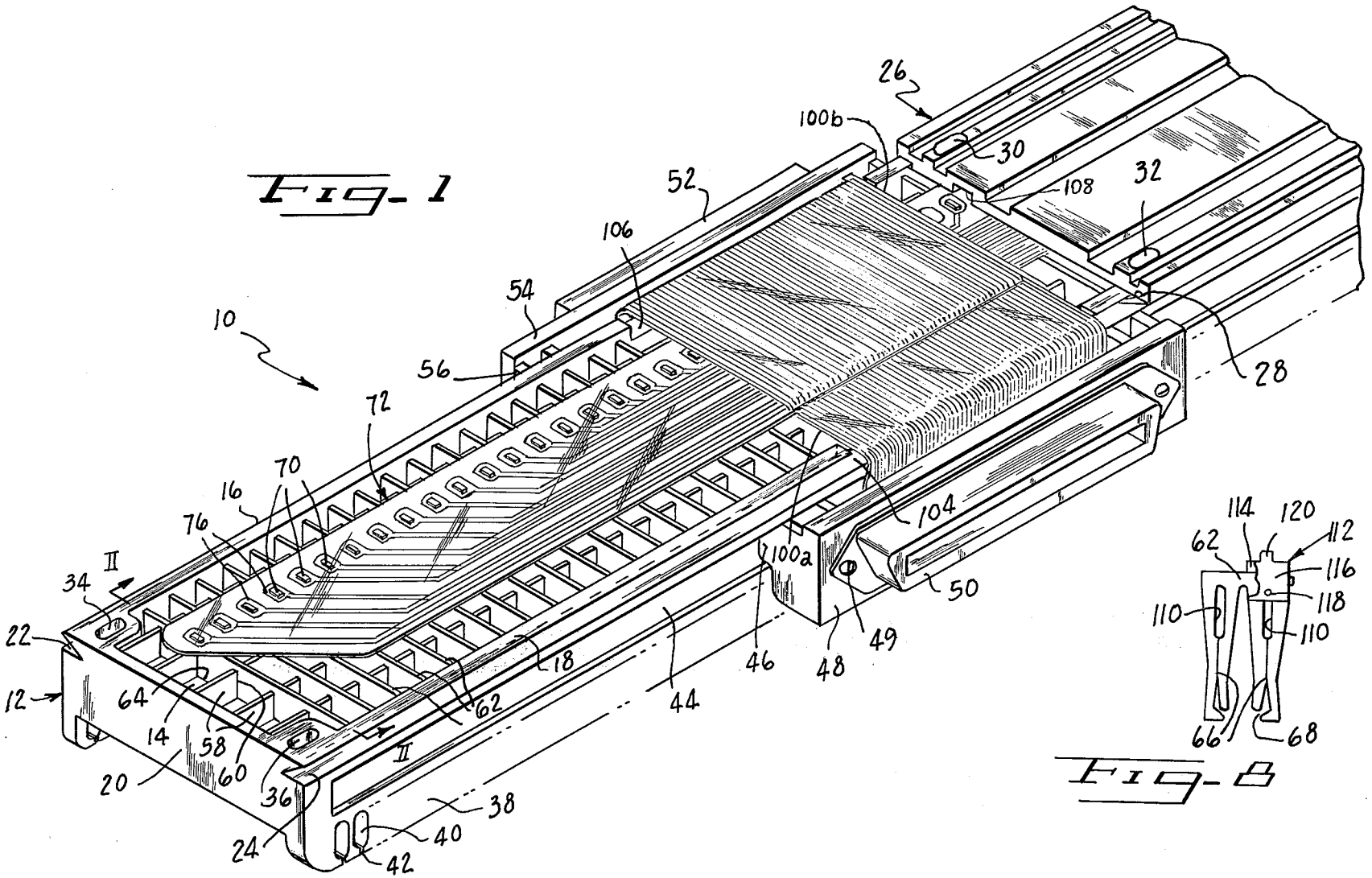
FIG. 1 is a pictorial representation of a terminal block assembly having a pair of electrical connectors mounted thereon, as seen substantially from the rear.
FIG. 8 is an elevational view of a clip type terminal-to-circuit contact.
Figures 2, 3, 4, 5, 6, 7:
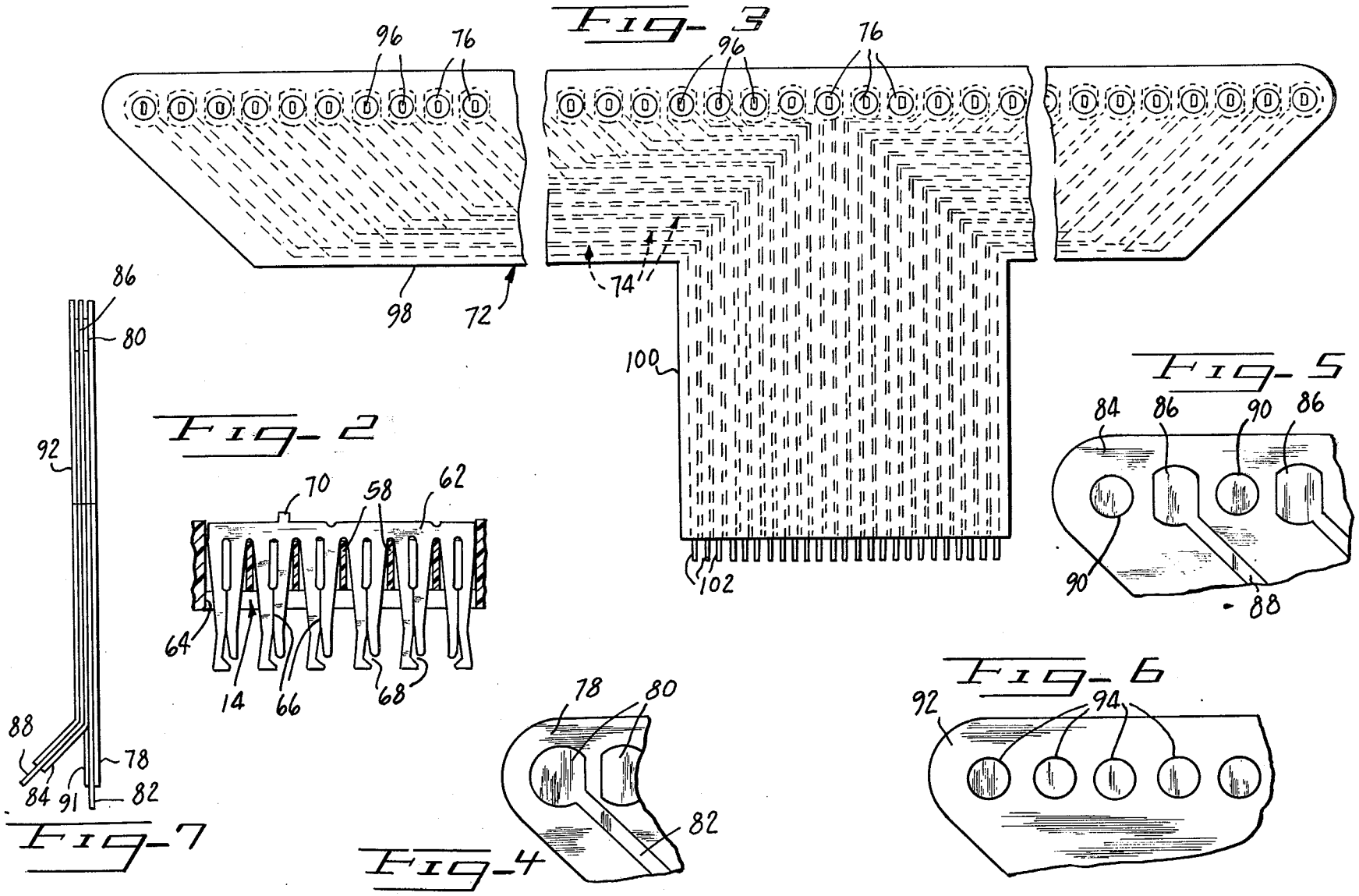
FIG. 2 is a sectional view taken substantially along the line II—II of FIG. 1.
FIG. 3 is a plan view of a flat flexible circuit member for use in practicing the present invention.
FIGS. 4–6 are portions of a laminated flat flexible circuit member to illustrate a particular interconnecting pattern between the contacts of an electrical connector and the terminals of a terminal block.
FIG. 7 is an end view of the assembled laminated circuit.

Referring to FIGS. 1 and 2, a terminal block assembly is generally illustrated at 10 as comprising a terminal block 12 having a generally flat portion 14, a pair of upstanding sidewalls 16 and 18, and a pair of end walls 20 (only one illustrated in the drawing).

The sidewalls 16 and 18 are provided with respective longitudinally extending dovetail grooves 22 and 24, respectively, for receiving a corresponding pair of projections 28 (only one shown) of a cover 26. The cover 26 is therefore slidable along the sidewalls 16 and 18 and may be engaged in a final position by means of a plurality of holes for receiving screws, as indicated at 30, 34; 32, 36.

The sidewall 18 extends in the opposite direction and includes a portion 38 having a plurality of conductor receiving passageways 40 with a corresponding plurality of access slots 42. As is already known in the art, individual conductors connected to the terminals of the terminal block are dressed into the passages 40 through the slots 42. A similar structure is provided on the opposite side of the terminal block.

The terminal block 12 also comprises an elongate recess 44 in each sidewall for releasably engaging flames 46 of a connector adaptor or retainer 48, as is generally disclosed in my aforementioned application Ser. No. 407,127, now U.S. Pat. No. 3,887,259.

A connector 50 is mounted to the adaptor by means of screws 49, or by other suitable fastening means. On the opposite side of the connector a similar construction is provided wherein a connector 52 is mounted to an adaptor or retainer 54 which, in turn, is releasably engaged with the terminal block 12 at the flanges 56.

The terminal block 12 is provided with a plurality of longitudinally extending intermediate walls 58 which extend outwardly from the flat portion 14 a distance less than that of the upstanding walls 16 and 18. The intermediate walls 58 may be provided with a slot at 60 to locate and position a plurality of terminals 62 below the extent of the sidewalls 16 and 18 or with their ends intermediate the side walls.

The terminal 62 extend through a transverse slot 64 (or a plurality of aligned transverse slots) and include insulation-piercing ends 66 having a wire guide opening 68. In FIG. 2, the terminals are illustrated with individual forward ends and common rear ends. This, of course, is not necessary and each terminal may be separate structures, or, for example, in a transversely oriented group of six terminals, the terminals may be separated in groups of two or three, etc. Each separate terminal entity, however, is provided with a terminal contact projection 70 for connection of the terminal to a flat circuit member 72, as illustrated in FIG. 1.

Referring to FIG. 3, the flat circuit member 72 is illustrated as a laminated structure having a plurality of individual circuits 74 which may be selectively connected to the contact projections 70 at contact lands 76, the contact projections 70 extending through respective slots 96 and soldered to the lands.

As illustrated in FIG. 3, the flat circuit member 72 is generally T-shaped including a cross bar portion 98 and a leg portion 100 at the end of which is a plurality of connecting portions or circuit terminals 102 for connection to the contacts of an electrical connector. In FIG. 1, the leg of the T has been further referenced 100a and 100b to illustrate the difference in length of such legs in applications where one flat circuit is to connect to a connector on one side of the terminal block and the other flat circuit is to be connected to another electrical connector located on the opposite side of the terminal block. It is readily apparent that when this type of terminal block-connector relationship is employed, the flat circuit member must be flexible so that it may be folded back over itself.

Attention is invited to the exit of the flat circuit members from the terminal block in FIG. 1. A pair of recesses 104 and 106 are provided in the respective sidewalls 18 and 16, for passage of the respective circuit members and to maintain the flat circuits in a noninterfering relationship with the cover 26.

One skilled in the art will appreciate that selective interconnection of one or more electrical connectors and the terminals of a terminal block may be accomplished in a simple manner in practicing the present invention. A particular type of interconnection and the method of achieving the same is explained below with reference to FIGS. 4–6.

Referring to FIG. 4, a suitable insulating material, such as 3 mil polyester has a layer of conductive material, such as copper, applied thereto, masked, and etched in accordance with well known techniques to provide a desired conductive pattern. In FIG. 4, a bottom portion of a multi-layer structure is illustrated which has been so etched to provide a plurality of conductive paths 80 and a plurality of circuit portions 82 (portions of the individual circuits 74) on a substrate 78. In FIG. 5 a similar process is performed with a flexible insulating layer 84 to provide a plurality of conductive paths 86 and a plurality of circuit portions 88 (also portions of the individual circuits 74). Conductive material is bonded to a suitable insulating material and a protective coating the shape of the conductive circuit portions 86 and 88 is applied. The coating prevents copper from being etched when the laminate is submerged in acid to form circuit portions 82 and 88. After etching, the protective coating over the circuit is removed exposing the copper. A plurality of holes 90 are then fabricated in the insulating material 84. The holes 90 will expose conductive material 80, in FIG. 4, when the laminate 84 and 86, FIG. 5, are bonded to the laminate 78 and 80, FIG. 4. The laminates in FIG. 4 and FIG. 5 are bonded together with the copper or conductive material up.

In FIG. 6 a flexible layer 92 of insulation material is fabricated and provided with a plurality of holes 94 which expose the conductive material 80, FIG. 4, and 86, FIG. 5, when the laminates shown in FIG. 4 and FIG. 5 are bonded to the insulation material 92, FIG. 6. In retrospect, the layer structure of FIG. 5, as mentioned above, is placed over the layer structure of FIG. 4, and then covered with the layer structure of FIG. 6, after which the stacked lamination is bonded together to form an integral circuit member. After the laminating process, heat sealing, a plurality of slots 96, FIG. 3 are punched through the flat flexible circuit member at exposed copper or conductive material sections 80, FIG. 4, and 86, FIG. 5, to receive the contact projections 70 of the terminals 62 in FIG. 2.

In FIG. 7 a side view is shown of the lamination. This view shows a separation of the laminate 78, 82 and the laminate 84, 88 at the end of extension 100. The separation is necessary to permit exposed copper portions, the conductive material 88 and 82, to be easily terminated or soldered to connectors 50 and 52. The conductive material 88 is soldered to one side of a connector and the conductive material 82 is soldered to the other side of the connector. An insulating strip 91 in FIG. 7 is bonded to the copper or conductive material side of laminate shown in FIG. 4; it acts as an insulator for the portion of the laminate 78, 82 that would be exposed.

It is readily apparent that many other circuit combinations and interconnecting procedures for the laminated structure may be utilized in practicing the present invention, including the use of plated-through holes and a variety of individual circuit configurations.

In assembling the apparatus illustrated in FIG. 1, for example, the circuit with the shorter leg 100*a* is first fed through the connector retainer 48 and has its terminal portions 82, 88 soldered to the contacts of the connector 50. Next, the slots 96 (FIG. 3) are aligned with and receive the contact projections 70 of the terminals, and the projections 70 are soldered to the conductive lands 80, 86. The leg 100*a* of the flexible circuit is then positioned in the recess 104 and the connector retainer 48 is snapped in place.

A similar operation is required for the upper flexible circuit illustrated in FIG. 1, with the exception that the longer leg 100*b* is folded back over the flexible circuit and positioned within the recess 106. Thus is will be seen that the terminal block or terminal block assembly 12 connects a plurality of conductors to respective contacts of connector 50 by means of a plurality of terminals or contacts 62 supported in a matrix of rows and columns and defining a plane supporting member 72 with each contact having an insulation piercing end 66 for connection to a respective conductor and a projecting end 70 connected to conductive circuits or segments 74 of the flat circuit member 72. The segments 74 are spaced along one longitudinal section of the circuit member in correspondence with the spacing between the rows for connection to the end 70 of a respective contact in one column and spaced along another shorter longitudinal section of the circuit member in correspondence with the dimension of the recess, opening or passageway 106 in the wall 16 or 18 and the passageway in the adaptor or retainer which are longitudinally shorter than the column of contacts. Thus the connections from the contacts of the block, which extend longitudinally a greater distance or beyond one end of the passageways and the contacts of the connector are facilely extended through the opening or passageway 106 in the side wall and through the short passageway in the adaptor to the relatively short connector 50 supported on the wall with the adaptor or retainer.

Referring to FIG. 8, a different structure is illustrated for extending connections between the terminals and the flexible flat circuits. The insulation-piercing slots 66 of the terminals develop into elongate apertures 110. A metal clip 112 includes a pair of spaced side portions 114 and 116 which embrace the terminals, at least one of the portions 114, 116 having an inwardly extending dimple 118 to be received in an aperture 110. A projecting portion 120 functions the same as the projection 70 for connection to a flat flexible circuit.

With both and/or other circuits and connectors assembled to the terminal block, the cover 26 is slid over the flat circuits, clearance therebetween having been provided by the recesses.

It is apparent that in practicing the invention, one may connect several terminal blocks together to advantage. Terminal blocks may be interconnected by flat flexible circuit members, or by cables extending between respective electrical connectors of separate terminal blocks. Also, as indicated above, more than two connectors may be employed with a terminal block if a corresponding recess is provided for receiving the flexible circuit leg. Furthermore, the leg of the T-shaped circuit member may take other than a central position as particular applications and space dictate.

It should also be noted that the cover may not be required in some applications, for example when the terminal block is to be mounted on an open frame structure or against an insulating wall. Also, clearance between the cover and the terminals and flat circuits may be at least partially obtained by providing a clearance groove in the inside face of the cover. In the embodiment illustrated in FIG. 1, for example, additional clearance for the terminal contact projections 70 has been provided by means of a groove 108.

Although I have described my invention by reference to a particular illustrative embodiment thereof, many changes and modifications of the invention, other than those set forth above, may become apparent to those skilled in the art without departing from the spirit and scope of the invention. I therefore intend to include within the patent warranted hereon all such changes and modifications as may reasonably and properly be included within the scope of my contribution to the art.

I claim:

1. A terminal block comprising:

a housing including a flat portion having a plurality of slots therethrough, a pair of spaced outside walls extending above said flat portion, a pair of elongate grooves in respective ones of said outside walls, a first recess in one of said outside walls, a second recess in said one outside wall adjacent said first recess, and a cover including a pair of spaced projections slidably received in respective ones of said elongate grooves;

a plurality of terminals carried by said housing, said terminals extending through said slots and each terminal including an insulation-piercing portion disposed outside of said housing for connection to a conductor and a second portion within said housing below the extent of said outside walls;

a flat circuit member mounted within said housing, said flat circuit member including a first longitudinal section of one dimension and a second longitudinal section of smaller dimension and a plurality of circuits extending between said first section and said second section and connected to selected second portions of said terminals at said first section with said second section extending through said first recess, said circuit member including a connection portion extending from a circuit in said second section;

a connector retainer including a portion for engagement within said second recess; and an electrical connector connected to said retainer, said connector including contacts connected to said connection portion of said flat circuit member extending through the adjacent first recess.

2. The terminal block of claim 1, wherein said flat circuit member is defined as a flexible flat circuit member.

3. A terminal block for use with a flat circuit member having a first longitudinal section of one longitudinal dimension and a second longitudinal section of a smaller longitudinal dimension than said first section with conductive segments extending from said first section to said second section, comprising:

a housing including means defining a shallow cavity for receiving said flat circuit member;

a plurality of terminals extending from said housing and including a common connection projection within said cavity for connection to a respective conductive segment of the flat circuit member in said first longitudinal section; and means defining an opening extending longitudinally of said housing for a distance less than said one longitudinal dimension for receiving the second section of said flat circuit member therethrough;

said housing including a pair of side walls extending above said common connection projection, said side walls having respective elongate grooves therein, a cover including a pair of projections which are slidably received in respective ones of said elongate grooves, a portion which extends into said cavity, and an elongate groove in said portion for providing clearance for said common connection projection as said cover is slid onto said housing, an electrical connector having contacts for connection to the conductive segments of the second section of the flat circuit member; and a connector adapter mounting said electrical connector adjacent said opening.

4. A terminal block comprising:

a housing including a flat portion having a plurality of slots therethrough, a pair of spaced outside walls extending above said flat portion, a pair of elongate grooves in respectivie ones of said outside walls, a first pair of recesses in respective ones of said outside walls, a second pair of recesses in respective ones of said outside walls adjacent said first recesses, and a cover including a pair of spaced projections slidably received in respective ones of said elongate grooves;

a plurality of terminals carried by said housing, said terminals extending through said slots and each terminal including an insulation-piercing portion disposed outside of said housing for connection to a conductor and a second portion within said housing below the extent of said outside walls;

a pair of flat circuit members mounted within said housing with each flat circuit member including a first longitudinal section of one dimension and a second longitudinal section of smaller dimension, each of said circuit members including a plurality of circuits extending between a respectivie first section and a respective second section and connected to selected second portions of said terminals at the respective first section with the respective second section extending through a respective one of said first pair of recesses, each of said circuit members including a connection portion extending from a respective circuit in said second section;

a pair of connector retainers each including a portion for engagement within a respective one of said second recesses; and a pair of electrical connectors connected to respective ones of said retainers, each of said connectors including contacts connected to a respective connection portion of the flat circuit member extending through the adjacent first recess.

5. The terminal block of claim 4, wherein said flat circuit members are further defined as flexible flat circuit members.

6. The terminal block of claim 4, wherein said flat circuit members are mounted in a stacked relation and have coextensive portions, and wherein said connection portions extend perpendicularly to said coextensive portions and one of said connection portions is disposed in a folded relation to exit said housing in a direction opposite to that of the other connection portion.

* * * * *

UNITED STATES PATENT OFFICE

CERTIFICATE OF CORRECTION

PATENT NO. : 3,936,119

DATED : February 3, 1976

INVENTOR(S) : George Edward Ayer

It is certified that error appears in the above-identified patent and that said Letters Patent are hereby corrected as shown below:

Column 2, Line 49, change "flames" to -flanges-.

Column 7, Line 7, change "respectivie" to -respective-.

Signed and Sealed this

Fourteenth Day of September 1976

[SEAL]

*Attest:*

RUTH C. MASON
*Attesting Officer*

C. MARSHALL DANN
*Commissioner of Patents and Trademarks*